US005219402A

United States Patent [19]

Kondo et al.

[11] Patent Number: 5,219,402

[45] Date of Patent: Jun. 15, 1993

[54] STICK USABLE AT DAYTIME AND NIGHT

[76] Inventors: Yoshio Kondo, Paradion Sugaguchi 501, 1-26 Sugaguchi, Ekimae, Shinkawacho,Nishikasugai District,Aichi Prefercture; Mitsuru Kobayashi, 2-3107 Ohgawara, Ohshikamura, Shimoina District Nagano Prefercture, both of Japan

[21] Appl. No.: 877,647

[22] Filed: May 1, 1992

[30] Foreign Application Priority Data

Nov. 12, 1991 [JP] Japan ..... 3-295818

[51] Int. Cl.[5] ..... A45B 3/00

[52] U.S. Cl. ..... 135/66; 135/910; 362/102

[58] Field of Search ..... 135/65, 66, 911, 910; 362/102

[56] References Cited

U.S. PATENT DOCUMENTS

| | | | |
|---|---|---|---|
| 2,435,650 | 2/1948 | Greene | 135/66 X |
| 3,546,467 | 12/1970 | Benjamin, Jr. et al. | 135/911 X |
| 3,987,807 | 10/1976 | Varnell | 135/66 |
| 4,013,881 | 3/1977 | Sargent | 362/102 |
| 4,062,371 | 12/1977 | Bolen | 135/66 |
| 4,099,535 | 7/1978 | Hubachek | 135/66 |
| 4,236,544 | 12/1980 | Osaka | 135/911 X |
| 4,562,850 | 1/1986 | Earley et al. | 135/66 |
| 4,625,742 | 12/1986 | Phillips | 135/66 |
| 4,648,710 | 3/1987 | Ban et al. | 135/911 X |
| 4,858,125 | 8/1989 | Washizuka et al. | 135/65 X |

FOREIGN PATENT DOCUMENTS

| | | | |
|---|---|---|---|
| 0114929 | 8/1984 | European Pat. Off. | 135/911 |
| 2103950 | 9/1972 | Fed. Rep. of Germany | 135/911 |
| 540470 | 4/1922 | France | 362/102 |
| 0625709 | 9/1978 | U.S.S.R. | 135/911 |

*Primary Examiner*—Carl D. Friedman
*Assistant Examiner*—Lan M. Mai
*Attorney, Agent, or Firm*—Bauer & Schaffer

[57] ABSTRACT

A day-and-night stick is provided with is adapted to emit a light from a part thereof so that it can be used not only at daytime but at night. The stick is formed of a stick body and a grip section. The grip section has an electrically driven vibrator section. Battery driven light emitting section and colored lamp section are arranged in either the stick body or the grip section. The light emitting section is provided with a light source and a lens while the colored lamp section with a lamp and a lens. A battery for driving the light source and the lamp is arranged in the stick body so as to turn on and off the light source and the lamp by a switch.

2 Claims, 9 Drawing Sheets

STICK USABLE AT DAYTIME AND NIGHT

BACKGROUND OF THE INVENTION

1. Field of the Invention

The present invention relates to a stick, and more particularly, to a stick which can be used not only at daytime but also at night.

2. Description of the Prior Art

A conventionally used stick is generally made of wood and used by people who have trouble in the legs and loins.

This conventional stick, which has a stick body and a grip section integrated with each other, is cumbersome when not used and is made exclusively for a daytime use. It is therefore inconvenient to use such a conventional stick in the dark or at night. Particularly, when it is used at night on streets, traffic accidents may occur due to the stick because it cannot be seen by drivers and other people around the stick user.

OBJECTS AND SUMMARY OF THE INVENTION

In view of the problems mentioned above, it is an object of the present invention to provide a stick which can be used also at night. More specifically, the object of the present invention is to provide a stick which can be used at daytime as before as well as at night by emitting a light such as a red-color light from the stick such that the user's feet are illuminated and accordingly the user can be recognized by other people even at night.

It is another object of the present invention to provide a stick which is provided with, not only a function of a conventional simple stick, but also a vibrating grip for producing a massage effect.

To achieve the above object, the present invention provides a stick usable at night as well as at daytime comprising: a stick body; and a grip section, wherein the grip section has an electrically driven vibrator section arranged therein, and battery driven light emitting section and colored lamp section are arranged in one of the stick body and the grip section.

DETAILED DESCRIPTION OF THE PREFERRED EMBODIMENTS

Embodiments of the present invention will hereinafter be described with reference to the accompanying drawings.

Figure 1:
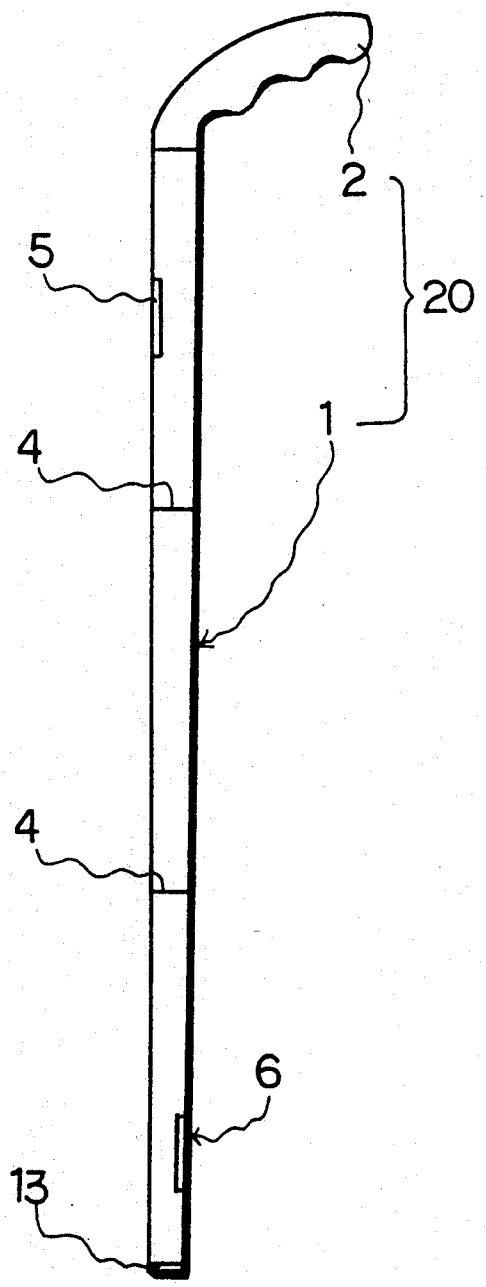
FIG. 1 is a plan view showing the appearance of a stick for daytime and night according to the present invention.
Figure 2:
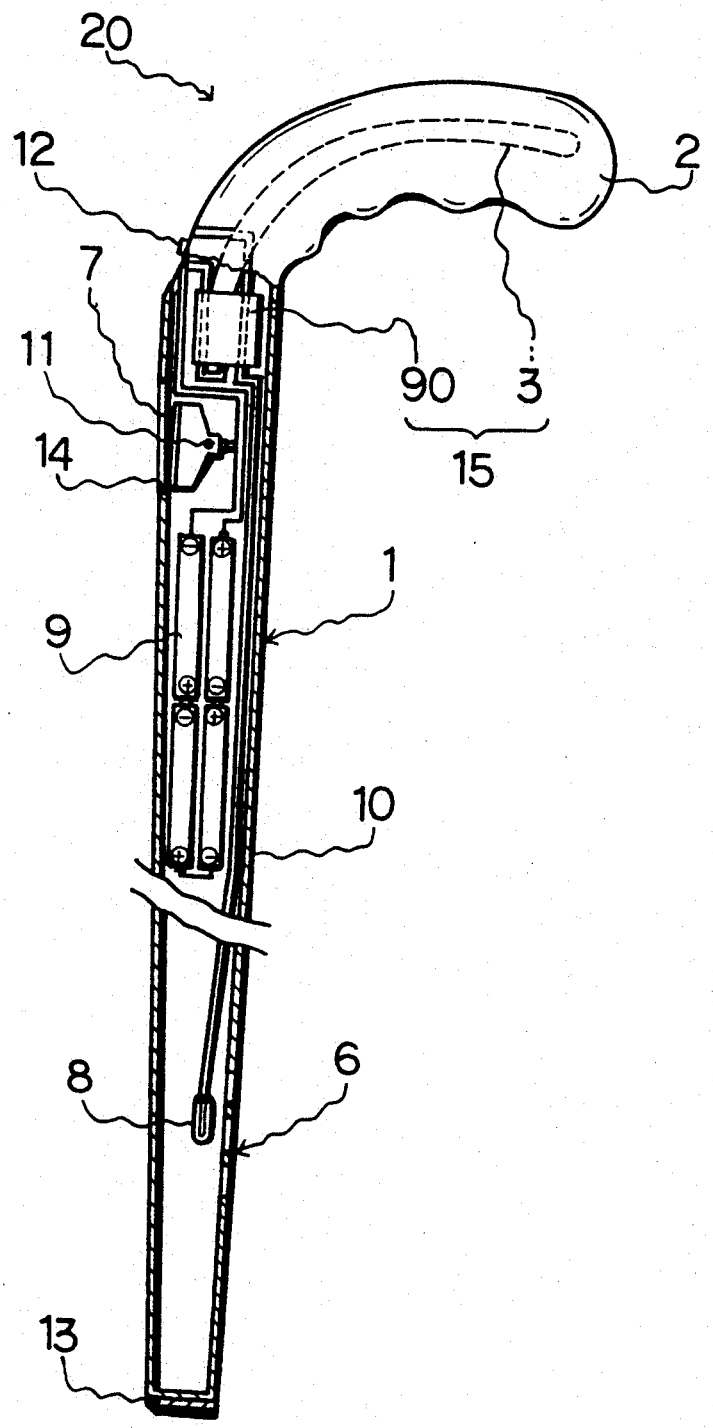
FIG. 2 is a schematic diagram showing the internal structure of the stick for daytime and night of the present invention.

FIGS. 1 and 2 shows a day-and-night stick 20 according to the present invention which is formed of a stick body 1 and a grip section 2.

A stick body 1 has a stick portion which is made telescopically drawn and stretched by sliders 4 and connected to the grip section 2. Reference numeral 5 designates a light emitting lens which is vertically movably mounted in an opening formed in an upper surface of the stick body 1. Reference numeral 6 designates a lamp section in which a lamp 8, later referred to, disposed in an opening formed in a lower back surface of the stick body 1 emits a light. In this particular embodiment, the lamp 8 is supposed to emit a red light, however, the light may be of any color as long as it is readily recognized by people around the user of the stick.

Next, the internal structure of the stick body 1 will be explained with reference to FIG. 2.

The stick body 1 is provided therein with a light emitting section 7 having a removable light as may be used as a flashlight, the lamp 8 for emitting a red light from the lamp section 6, a battery as a power source for operating these two sections 6, 7, and a motor 90 for vibrating a rod 3 disposed in the grip section 2 where the motor 90 and the rod 3 constitute a vibration section 15. Also, reference numeral 10 designates a wiring connected to a switch, 11 a pin for fixing the light emitting section 7, 12 a switch for operating and stopping the vibrating rod 3 used as a vibrator, and 13 a rubber cap attached on an end portion of the stick body 1 for preventing slippage.

Figure 3:
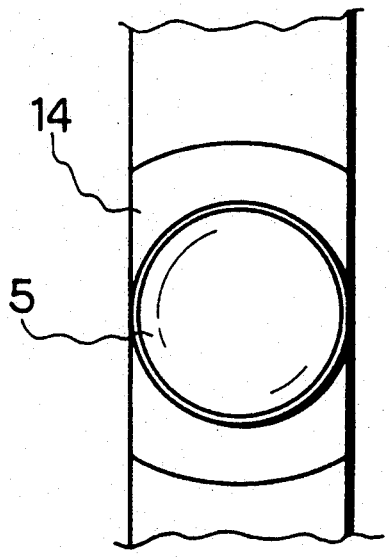
FIG. 3 is a partially enlarged diagram showing a main portion (a light emitting lens) of the stick according to the present invention.
Figure 4:
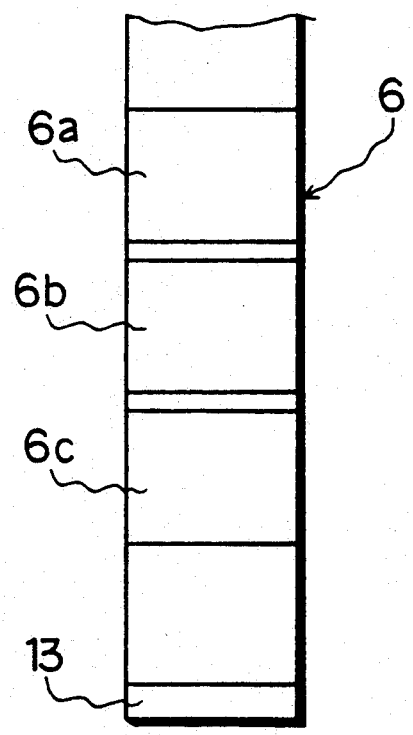
FIG. 4 is a partially enlarged diagram showing a main portion (a red light emitting portion) of the stick.

FIGS. 3 and 4 are partially enlarged diagrams respectively showing the light emitting lens 5 and the red lamp section 6 arranged in the stick body 1. For the light emitting lens 5, a red lens or the like is employed such that a light from the light emitting section 7 comprising a removable flashlight is clearly emitted. Also, the light emitting lens 5 is constructed for vertical movement. The red lamp section 6 has three openings 6*a*, 6*b* and 6*c* formed therein, in each of which a lens in red color, by way of example, is inserted. Incidentally, the rubber cap 13 may be made of an anti slippage material such as rubber.

Figure 5:
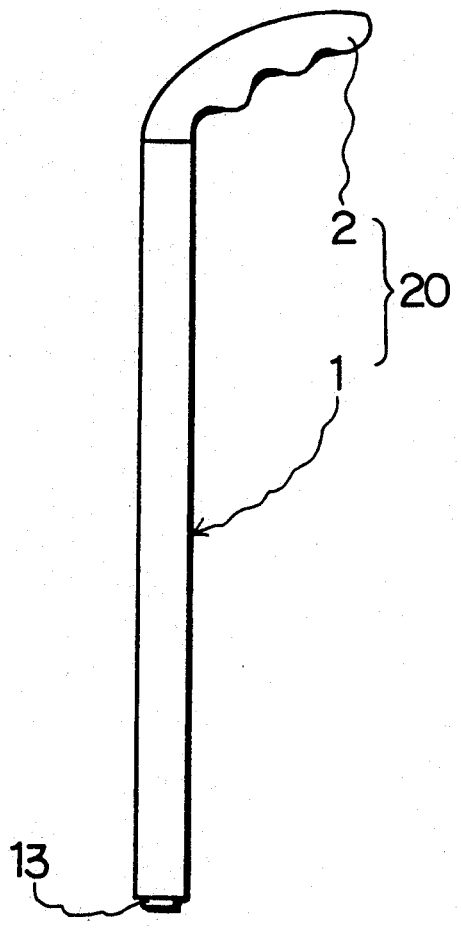
FIG. 5 is a schematic diagram showing a drawn state of the stick.

FIG. 5 shows an unused state of the day-and-night stick 20. Specifically, the stick body 1 is telescopically accommodated in an upper portion thereof. It will therefore be understood that this day-and-night stick 20 may be carried with the grip section 2 being held by a hand or may be put in a bag or the like.

Next, another embodiment of the present invention will be described with reference to FIGS. 6–9.

Figure 6:
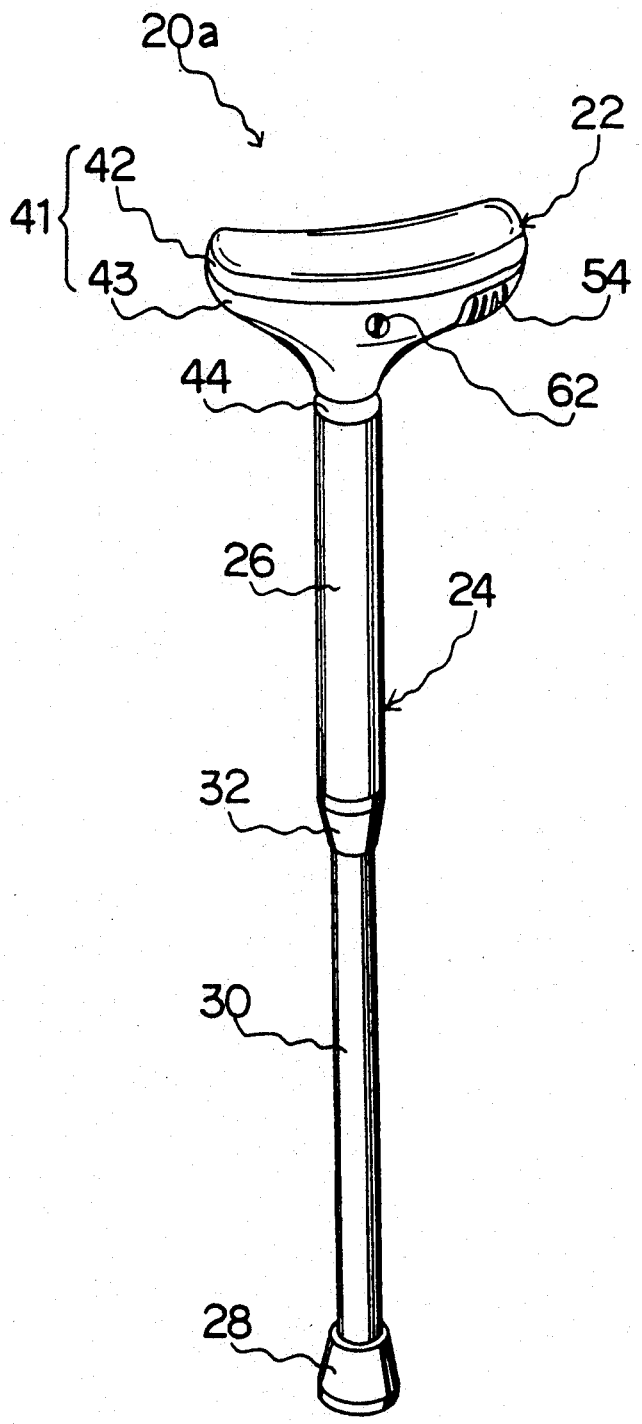
FIG. 6 is a perspective view showing a second embodiment of the present invention.
Figure 7A:
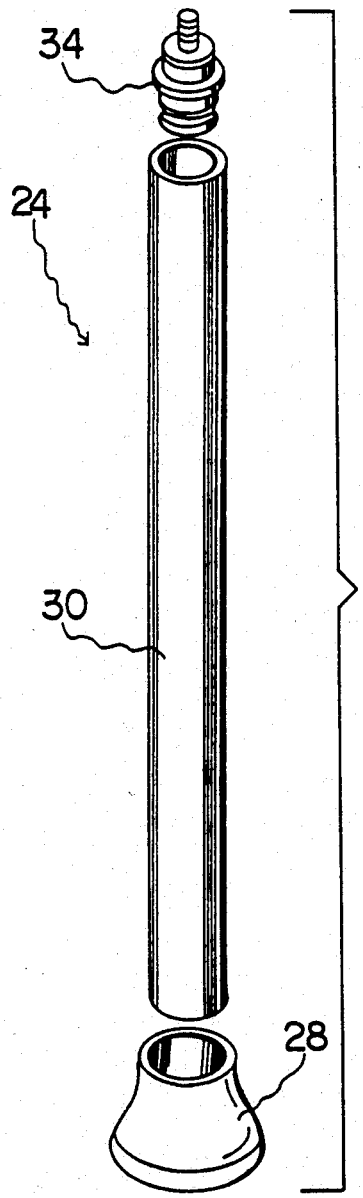
FIG. 7A is an exploded view of the lower portion of a hollow stick employed in the second embodiment of the invention.
Figure 7B:
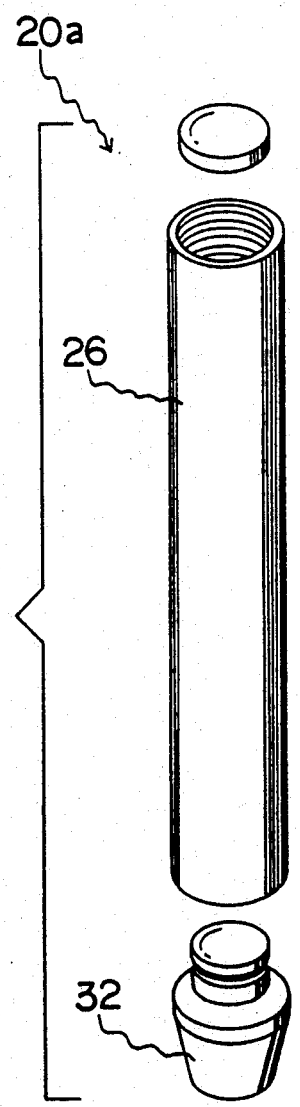
FIG. 7B is a view similar to FIG. 7A showing the upper portion of the hollow stick.
Figure 8:
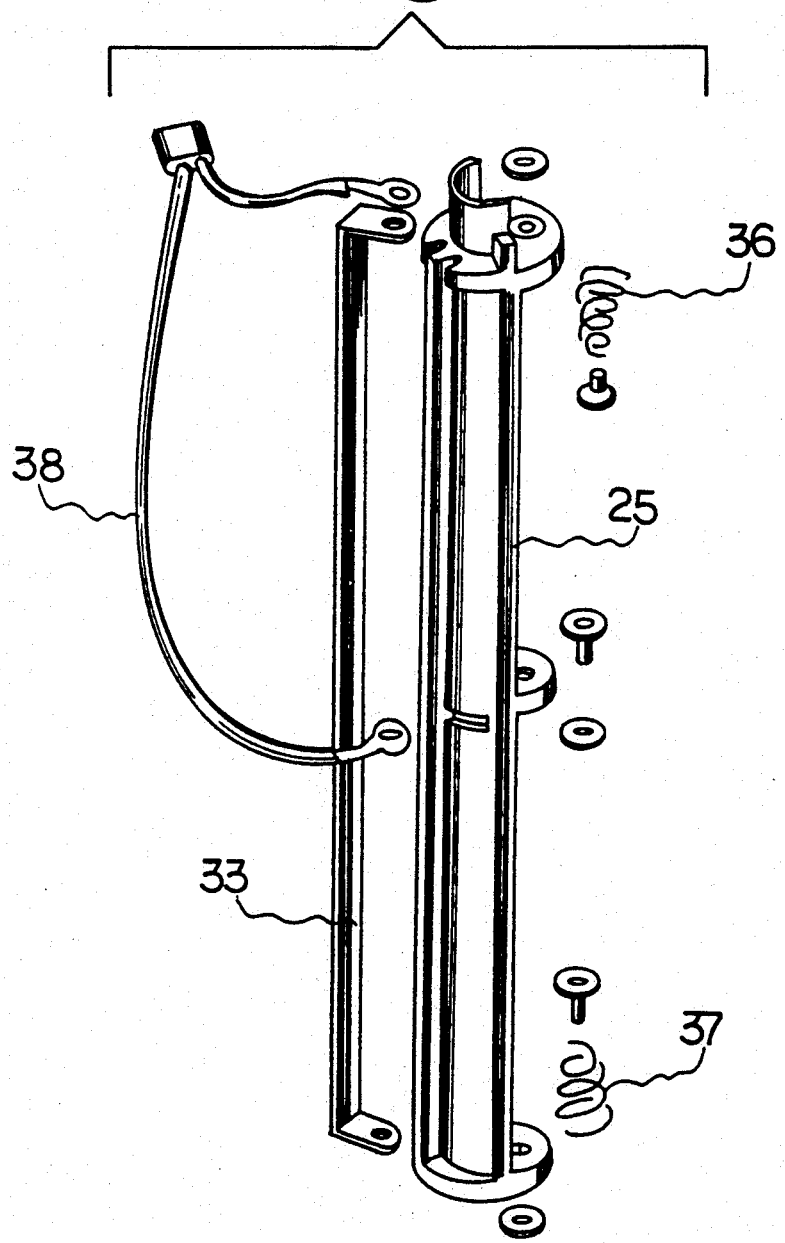
FIG. 8 is an exploded view showing the elements of the battery case employed in the second embodiment.

A day and night stick, as shown in FIG. 6, is formed of a stick body 22 and a grip section 24. The stick body 22, as shown in FIG. 7, comprises an upper pipe 26 having a built-in battery case 25 (see FIG. 8) for holding batteries therein and a lower pipe 30 having a rubber cap 29 embedded in the lower end thereof, the upper and lower pipes being coupled by joiners 32 and 34. As shown in FIG. 8, the battery case 25 is provided with contact springs 36 and 37 with are connected with each other through a harness plate 33. A battery held by this battery case 25 is electrically connected to a base plate 40 accommodated in the grip section 24 by adapters 38 and 39.

Figure 9:
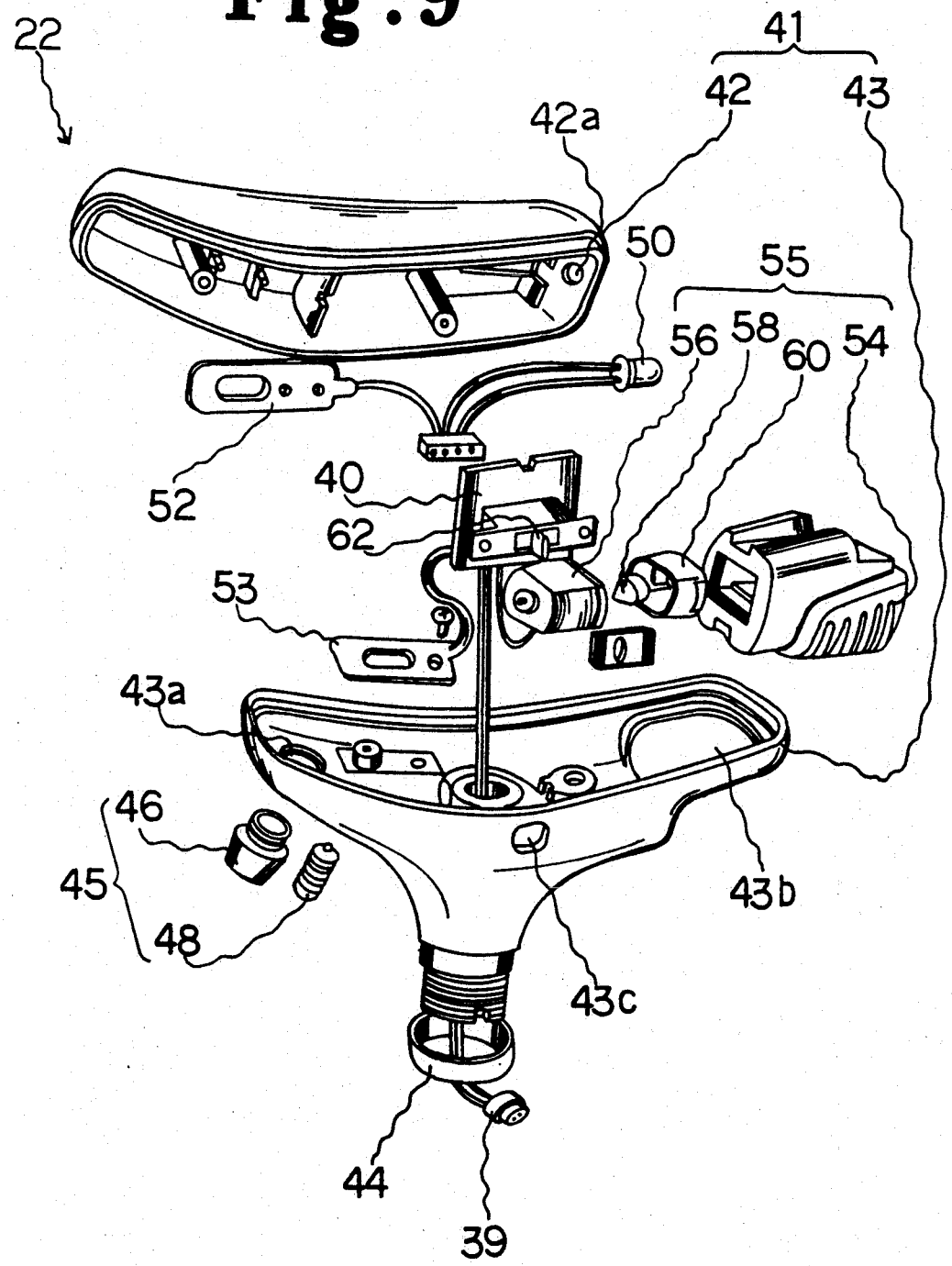
FIG. 9 is an exploded view of the head body of the stick employed in the second. embodiment of the present invention.

The grip section 24, as shown in FIG. 9, has a handle grip 41 which is divided into an upper grip member 42 and a lower grip member 43 integrated to each other by screws. A lower end portion of the lower grip member 43 can be secured to an upper end portion of the upper pipe 26 of the stick body 22 through an accessory ring 44 by thread.

The lower grip member 43 of the handle grip 41 are formed with a hole 43*a* in which a light emitting section 45 is arranged. Specifically, the light emitting section 45 has a lamp bezel 46 screwed in the hole 43*a*, and a lamp 48 is mounted in this lamp bezel 46. The light emitting section 45 is provided for illuminating the ground at the user's feet in the dark. A red light section 50 is arranged in a hole 42*a* formed in the upper grip member 42 at a location opposite to the hole 43*a* in the lower grip member 43. The red light section 50 employs a light emitting diode as a light source. This light emitting diode blinks to indicate the existence of a pedestrian to drivers and other nearby people. This light emitting diode is electrically connected to a battery through a connection with a base plate 40. The lamp 48 is electrically connected to the battery through contact plates 52 and 53 which are connected to the base plate 40.

A vibrator section 55 is also arranged in this handle grip 41. The vibrator section 55 is provided with a motor 56 for vibrating a vibrator pat 54, similarly to the embodiment shown in FIGS. 1-5. The motor 56 has a weight 58 mounted therein and accommodated in the vibrator pat 54 through a motor cover 60. The vibrator pat 54 has its portion exposed through an opening 43*b* formed through the lower grip member 43 such that vibration is directly propagated to a hand gripping the handle grip 41 to provide a massage effect to the hand.

The above-mentioned lamp 48, light emitting diode and motor 56 are seen through a hole 43*c* formed through the lower grip 43 in a central portion thereof, and are tuned on and off by a switch 62 mounted on the base plate 40.

The present invention, as constructed as described above, provides a day-and-night stick as well as produces the following many effects.

First, only by arranging the light emitting section, the red lamp section and the battery as a power source therefor, both sections can be operated by the battery in a manner that lights are emitted from these two sections by a simple switching manipulation. When the stick is used at night, lights are emitted from the light emitting section and the red lamp section, wherein the light from the light emitting section illuminates the ground at the user's feet to facilitate walking of the user, while the red light from the red lamp section has people around the user such as drivers recognize the position of the user, thereby preventing traffic accidents.

Since the grip is vibrated by the motor turned on and off by a switch, gripping the grip of the stick causes the palm to be vibrated, thereby producing a massage effect. Further, by contacting the vibrating grip to a neck, legs and loins, a part suffering from muscular pain and so on, the stick may be used as a massage tool.

Further, since the stick body is telescopically drawn and stretched, it can be shortened when not used. Thus, it is very convenient for aged or handicapped people, particularly, those having trouble in the legs and loins, to carry, as compared with a conventional stick.

We claim:

1. An invalid cane usable at night as well as at daytime comprising a stick body having a grip at one end and formed with a light emitting section arranged to illuminate the ground and a colored lamp section spaced therefrom to provide a warning to others, light means located in each of said sections, a current source located within said stick connected to said light means, vibrator means located in said grip, motor means connected to said current source for driving said vibrator, and switch means interposed between said current source and said light means and vibrator motor means to selectively control the operation of each.

2. The cane according to claim 1, wherein said stick body is formed of a plurality of sections, said sections being arranged so as to be collapsible, said light emitting section and said colored lamp section being located in different stick sections.

* * * * *